US006194357B1

(12) United States Patent
Murata et al.

(10) Patent No.: US 6,194,357 B1
(45) Date of Patent: Feb. 27, 2001

(54) WATERBORNE LUBRICANT FOR THE COLD PLASTIC WORKING OF METALS

(75) Inventors: Motoharu Murata; Yoshio Matsumura; Yoshihiko Nishizawa, all of Hiratsuka; Takashi Koyama, Hachioji, all of (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/202,766

(22) PCT Filed: Jun. 23, 1997

(86) PCT No.: PCT/US97/10108

§ 371 Date: Dec. 21, 1998

§ 102(e) Date: Dec. 21, 1998

(87) PCT Pub. No.: WO97/48783

PCT Pub. Date: Dec. 24, 1997

(30) Foreign Application Priority Data

Jun. 21, 1996 (JP) ..... 8-181396

(51) Int. Cl.[7] ..... C10M 173/00; B21B 45/02

(52) U.S. Cl. ..... 508/113; 508/148; 508/143; 508/154; 508/156; 508/158; 508/539; 508/175; 72/42; 72/43; 72/46

(58) Field of Search ..... 508/148, 136, 508/156, 158, 175, 113; 72/42

(56) References Cited

U.S. PATENT DOCUMENTS 3,313,727 * 4/1967 Peeler ..... 508/156
3,936,314 * 2/1976 Smigel ..... 508/158
3,974,674 * 8/1976 Orozco et al. ..... 72/42
4,262,057 * 4/1981 Godek et al. ..... 428/470
4,336,147 * 6/1982 Stayner ..... 508/156
4,337,161 * 6/1982 Stayer ..... 508/156
4,350,034 * 9/1982 Godek et al. ..... 72/42
4,803,000 * 2/1989 Uematsu et al. ..... 508/431
5,116,521 * 5/1992 Fujii et al. ..... 508/163

OTHER PUBLICATIONS

Japan 92–001798—Jan. 14, 1992 (English Abstract only).
Japan 83–030358—Jun. 28, 1983 (English Abstract only).
Japan 52–020967—Feb. 17, 1977 (English Abstract only).

* cited by examiner

*Primary Examiner*—Ellen M. McAvoy
(74) *Attorney, Agent, or Firm*—Wayne C. Jaeschke; Stephen D. Harper; Norvell E. Wisdom, Jr.

(57) ABSTRACT

Waterborne lubricants comprising: (A) water-soluble inorganic salt; (B) homogeneously dispersed solid lubricant; (C) at least one homogeneously emulsified substance selected from mineral oils, animal and plant oils and fats, and synthetic oils; (D) surfactant; and (E) water, in which the weight ratio (B)/(A) is from 0.05:1 to 2:1 and the weight ratio {C/(A+B)} is from 0.05:1 to 1:1, provide a one-step, highly lubricating waterborne lubricant for use in the cold plastic working of metals. This waterborne lubricant can replace the conversion coating treatment (phosphate, oxalate, etc.)+reactive soap treatment combined lubrication system now in general use and is free of the environmental issues associated with the combined lubrication system, provides for facile coating removal, and is not subject to the decline in seizure resistance caused by nonuniform add-on when large numbers of workpieces are treated together by immersion.

16 Claims, 1 Drawing Sheet

WATERBORNE LUBRICANT FOR THE COLD PLASTIC WORKING OF METALS

FIELD OF THE INVENTION

This invention relates to a waterborne lubricant for use during the plastic cold working (e.g., forging, tube and pipe drawing, wire drawing, and the like) of stock of a metal such as iron, steel, titanium, titanium alloy, copper, copper alloy, aluminum, aluminum alloy, and the like. Below, this lubricant is referred to simply as the "waterborne lubricant".

REVIEW OF RELATED ART

Lubricants that form a liquid or solid film are used in the plastic working of metals, for example, in the cold drawing of steel tubing and pipe. These lubricants facilitate drawing by reducing the friction between the work piece and the tool, e.g., die, plug, or the like, and thereby prevent scuffing and seizure.

Among lubricants of this type, the so-called oil-based lubricants are typical of the liquid lubricants. The base oil in oil-based lubricants is a mineral oil, animal or plant oil, or a synthetic oil. Lubrication is generally carried out by flowing the oil-based lubricant directly onto the tool or work piece from a lubricating oil applicator built into the processing equipment. Oil-based lubricants are frequently used in the case of relatively low degrees of working. In the case of heavy working, the oil viscosity is increased or a solid lubricant or extreme-pressure additive is added. Typical of the solid films are the so-called conversion coatings in which a carrier film that tenaciously adheres to the substrate is formed by a reaction with the work piece. Phosphate coating treatments that form a zinc phosphate-based film are used with carbon steels and low-alloy steels, while oxalate coating treatments that form an iron oxalate-based film are used with stainless steel. A reactive soap lubrication treatment is generally performed after these conversion coating treatments. The combination of these two processes gives a lubrication method with a very high resistance to seizure, because of the combination of the carrier function of the conversion coating and the lubricating function of the reactive soap lubricant. This sequence of reactive soap lubrication treatment after a conversion coating treatment is generally carried out by immersing the work piece in various treatment baths prior to drawing. However, since reactive treatments are involved, the treatments are carried out on batches of several tens of units in order to minimize variations in lubricant add-on, even though parts of the work pieces may be brought into lineal contact with each other to a greater or lesser degree.

However, requirements for higher speeds and higher pressures in the working operation as well as environmental and energy considerations have created demand for a lubricant which can solve the problems associated with conversion films while still exhibiting a lubricating function equal to or greater than that for the combination of a conversion coating treatment with a reactive soap lubrication treatment. Conversion films are associated, for example, with environmental and cost problems and with problems in removing the lubricant film after the working that utilized the film is complete. The environmental problems include issues with waste management and issues concerned with the working environment. For example, due to the use of an acidic treatment bath maintained at 80° C. to 90° C., the treatment bath has a disagreeable odor and its mist degrades the immediate environment of the bath. The cost issues involve shortening the process and economizing on energy and space. Finally, the problems with post-working film removal have generally required alkaline degreasing plus an acid treatment.

Within the realm of oil-based lubricants that address the problems described above, Japanese Patent Publication [Kokoku] Number Hei 4-1798 [1,798/1992] discloses a "cold working lubricant in which a metal soap or solid lubricant is blended into a lubricating oil comprising the blend of a plant or animal oil, a copolymer of isobutylene and n-butene, and an extreme-pressure agent such as chlorinated paraffin or phosphate ester". However, even though this is a high-performance lubricating oil, its performance in working operations is somewhat poorer than that afforded by reactive soap lubrication treatment after a conversion coating treatment. Moreover, since large amounts of extreme-pressure agent (a term which is equivalent to "extreme-pressure additive") are used, undesirable odors are generated during the working operation and there is a risk of adverse effects such as work piece corrosion by chlorine or phosphorus in the post-working step of softening and annealing.

The waterborne lubricants include lubricants which are used wet and lubricants which are used in the form of their dried films. Like the oil-based lubricants discussed above, the wet-use waterborne lubricants are used by direct application to the tool or work piece. The dry-use waterborne lubricants, like the conversion films discussed above, provide a solid film by immersion in a treatment bath followed by evaporation of the water fraction in a drying process. An example of the wet-use waterborne lubricants is disclosed in Japanese Patent Publication [Kokoku] Number Sho 58-30358 [30,358/1983]. This reference discloses a "lubricant for the cold or hot working of metal tubing, comprising a bicarbonate salt (solid) as the main component and small amounts of dispersant, surfactant, and solid lubricant". This lubricant, however, has not achieved wide use in place of conversion coating treatments. With regard to dry-use waterborne lubricants, Japanese Patent Application Laid Open [Kokai or Unexamined] Number Sho 52-20967 [20,967/1977] teaches a "lubricating coating composition comprising water-soluble polymer or a waterborne emulsion thereof as its base, which is blended with solid lubricant and a conversion film-forming agent". In addition, Japanese Patent Application Laid Open [Kokai or Unexamined] Number Sho 50-147460 [147,460/1975] discloses a "method for drawing stainless steel wire using the combination of a borax-based film and lime soap or metal soap". However, when the dry film is produced by immersing a large number of workpieces at one time followed by forced drying, a nonuniform add-on is inevitably produced by the partial contact that occurs among workpieces. As a result, these dry-use lubricants are unable to solve a major problem with nonreactive lubricants, i.e., a pronounced tendency for seizure to occur during drawing operations.

Thus, as discussed above, no lubricant has appeared that can meet all of the demands elaborated above (single step, working performance, environmental issues, waste management, energy savings, film removal, etc.) and is able to replace the combined lubrication system of conversion coating treatment (phosphate treatment, oxalate treatment, etc.)+reactive soap treatment.

PROBLEMS TO BE SOLVED BY THE INVENTION

The present invention was developed in order to meet the requirements outlined above. The object of the present invention is to provide a one-step, highly lubricating waterborne lubricant for use in the cold plastic working of metals, that can replace the conversion coating treatment+reactive soap treatment combined lubrication system, is free of the environmental issues described above, provides for facile film removal, and/or is not subject to the decline in seizure resistance caused by nonuniform add-on when large numbers of individual workpieces are treated by immersion.

SUMMARY OF THE INVENTION

It has been found that the above stated object of the invention can be achieved by a waterborne lubricant comprising, preferably consisting essentially of, or more preferably consisting of, in addition to water:

(A) as its base, a water-soluble inorganic salt that strongly adheres to the substrate, and that can introduce the lubricating component(s) to the tool surface and maintain the lubricating component(s) in place during the cold working operation;

(B) as lubricating component, a solid lubricant;

(C) as lubricating component and/or lubrication auxiliary component, at least one substance selected from the group consisting of mineral oils, animal and plant oils and fats, and synthetic oils; and (D) surfactant, in which the solid lubricant:water-soluble inorganic salt weight ratio (B)/(A) is from 0.05:1 to 2:1, the oil component(water-soluble inorganic salt+solid lubricant) weight ratio (C)/(A)+(B) is from 0.05/1 to 1/1, the solid lubricant is homogeneously dispersed, and the oily component (C) is homogeneously emulsified.

When this waterborne lubricant is used in the cold plastic working of metals, which constitutes another embodiment of the invention, the drying process that follows treatment, e.g., by immersion, leads to the formation on the metal surface of a solid inorganic salt coating containing the solid lubricant in dispersed form and to the formation of an oily outer surface of the coating due to bleed by oily component (C) onto the outer surfaces of the film. This oily surface provides for a major improvement in seizure resistance by contributing to the initial lubrication during the working operation and by compensating for the nonuniform add-on of solid lubricant in any regions of the workpieces that have come into contact with each other during treatment and as a result have less treatment coating thickness than most parts of the workpieces.

In addition, the lubricating component remaining on the metal after plastic working can as a rule be removed by treatment with alkaline degreaser alone.

DETAILED DESCRIPTION OF THE INVENTION

Figure 1:
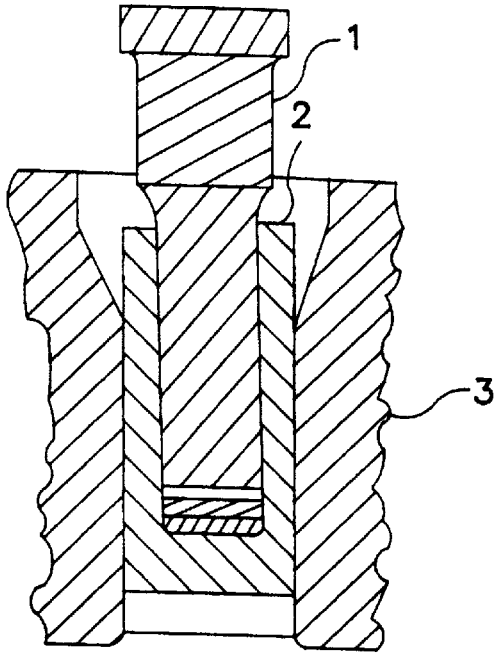
FIG. 1 is a sectional view of the die, punch, and test substrate for the backward punching test of carbon steel that was run using the waterborne lubricant.

Water-soluble inorganic salt component (A) constitutes the firm, solid, and highly metal-adherent coating formed by the waterborne lubricant according to the present invention. The chemical nature of this salt is not critical; it can be any water-soluble inorganic salt that forms the requisite type of coating, including those salts typically or generally used in prior art as a carrier in the cold plastic working of metals. This component is exemplified by borates such as sodium tetraborate (borax), potassium tetraborate, ammonium tetraborate, and the like; sulfates such as sodium sulfate, potassium sulfate, ammonium sulfate, and the like; silicates such as sodium silicate, potassium silicate, and the like; and nitrates such as sodium nitrate, potassium nitrate, and the like. Borax, potassium tetraborate, and sodium sulfate are preferred among the preceding. The water-soluble inorganic salt may be a single selection or a combination of two or more selections.

The solid lubricant (B) is homogeneously dispersed in the waterborne lubricant according to the present invention. It is taken up when the waterborne lubricant is coated on the workpiece and will be present mainly in the coating of water-soluble inorganic salt that is produced when the water fraction is evaporated during the drying process. The solid lubricant (B) contributes to preventing scuffing and seizure. The chemical nature of the solid lubricant is not critical; it can be any solid lubricant with the requisite physical properties, including those generally used for the cold plastic working of metals. Solid lubricant (B) is exemplified by metal soaps, micas, calcium compounds, metal sulfides, nitrides, metal oxides, and solid polymers. Metal soaps are metal salts of fatty acids. The fatty acids are exemplified by lauric acid, myristic acid, palmitic acid, stearic acid, behind acid, and hydroxystearic acid, with stearic acid being preferred. The metals are exemplified by calcium, aluminum, magnesium, barium, zinc, lead, lithium, and potassium. The subject metal soap is preferably calcium stearate. Micas are exemplified by sericite, muscovite, and synthetic micas; the calcium compounds are exemplified by calcium hydroxide, calcium carbonate, and the like; the metal sulfides are exemplified by molybdenum disulfide, tungsten disulfide, selenium disulfide, and the like; the nitrides are exemplified by boron nitride and the like; the metal oxides are exemplified by titanium oxide, zinc oxide, silica, and the like; and the solid polymers are exemplified by poly (tetrafluoroethene), hereinafter usually abbreviated as "PTFE", nylon, polyethylene, and the like. Other examples of the solid lubricant are graphite, talc, and metals. The solid lubricant generally takes the form of a powder. Among the preceding, micas and the metal soaps and specifically calcium stearate are preferred. These provide excellent lubricity while being free of substances that disturb annealing. The solid lubricant may be a single selection or a combination of two or more selections.

The oily component (C) is at least one selection from mineral oils, animal and plant oils and fats, and synthetic oils. This oily component (C) forms an oily surface on the dried coating of water-soluble inorganic salt afforded by application of the waterborne lubricant according to the present invention to the metal and thereafter drying. Oily component (C) compensates for the reduced lubricating performance of the solid lubricant in those regions of the workpieces that are characterized by nonuniform add-on of the solid lubricant.

The flash point, melting point, and viscosity of the oily component used in the present invention preferably fall within specific ranges. The flash point preferably falls in the range from 150° C. to 300° C. In the case of heavy cold plastic working, the average post-working temperature of the metal stock can reach up to 150° C. and above. When the flash point of the oily component is below 150° C., large amounts of gas may be generated post-working, which would create an ignition risk. A flash point in excess of 300° C. is undesirable because the associated viscosity and melting point will generally be high. The preferred range for the melting point is −20° C. to 20° C. A melting point in excess of 20° C. leads to a diminished emulsifiability and re-emulsifiability by the oil in the waterborne lubricant and thus to a tendency for the treatment bath stability to be reduced. An oily component with a melting point below −20° C. will typically have a reduced flash point. The viscosity of the oily component is preferably 5 to 100 centistokes stokes at 40° C. A viscosity below 5 centistokes is typically associated with a low flash point, which leads to the post-working generation of large amounts of gas and hence an ignition risk. Moreover, when the viscosity is below 5 centistokes, the slip between the solid lubricant particles is diminished and the lubrication performance tends to decline. A viscosity in excess of 100 centistokes usually leads to a diminished emulsifiability and re-emulsifiability of the oily component in the waterborne lubricant and thus to a tendency for the treatment bath stability to be reduced.

Mineral oils are exemplified by machine oils, turbine oils, spindle oils, and the like; animal and plant oils and fats are exemplified by palm oil, rapeseed oil, coconut oil, castor oil, beef tallow, lard, whale oil, and fish oils; and the synthetic oils are exemplified by ester oils and silicone oils. The ester oils are exemplified by the esters between a fatty acid such as stearic acid or oleic acid and a polyhydric alcohol such as ethylene glycol or trimethylolpropane. The silicone oils are exemplified by poly(dimethylsiloxane) and poly (diphenylsiloxane).

An oily component used by the present invention may be a single selection or a combination of two or more selections from the above-described mineral oils, animal and plant oils and fats, and synthetic oils. Regardless of the particular selection, the oily component preferably satisfies the above-described ranges for the flash point, melting point, and viscosity.

The oily component also has a secondary activity. When the waterborne lubricant according to the present invention is coated at elevated temperature on the metal workpiece(s), the waterborne lubricant is typically heated by steam tubes prior to its application. The presence of the oily component inhibits adhesion by the solid lubricant to the heating tubes during this process.

Surfactant component (D) functions in a waterborne lubricant according to the present invention to emulsify the oily component homogeneously in the water and also to disperse the solid lubricant homogeneously in the water. This surfactant can be a nonionic, anionic, amphoteric, or cationic surfactant. The chemical nature of the nonionic surfactant is not critical and is exemplified by polyoxyethylene alkyl ethers, polyoxyethylene alkylphenyl ethers, polyoxyethylene alkyl esters derived from polyethylene glycol and higher fatty acids (e.g., $C_{12}$–$C_{18}$ fatty acids), and polyoxyethylene sorbitan alkyl esters deriving from higher fatty acids (e.g., $C_{12}$–$C_{18}$ fatty acids), sorbitan, and polyethylene glycol (or ethylene oxide). The chemical nature of the anionic surfactant is not critical and is exemplified by fatty acid salts, the salts of sulfate esters, sulfonates, the salts of phosphate esters, and the salts of dithiophosphate esters. The chemical nature of the amphoteric surfactant is not critical and is exemplified by amino acid-type and betaine-type carboxylates, sulfate ester salts, sulfonate salts, and phosphate ester salts. The chemical nature of the cationic surfactant is not critical and is exemplified by fatty amine salts and quatemary ammonium salts. A surfactant component can be a single selection or a combination of two or more selections.

Water functions as a dispersion medium for the solid lubricant, as a medium for the homogeneous emulsification of the oily component through the action of the surfactant, and as a solvent for the water-soluble inorganic salt.

In addition to the essential components described above, a waterborne lubricant according to the present invention may contain a conventional waterborne lubricant for the cold plastic working of metals. It may also contain an oiliness improver such as a fatty acid or higher alcohol, an extreme-pressure additive such as a chlorine-based or sulfur-based extreme-pressure additive, a defoamer, and a preservative. The waterborne lubricant according to the present invention may additionally contain a colloidal titanium compound for the purpose of improving the lubricity and rust prevention. The subject colloidal titanium compound is exemplified by the turbid liquids afforded by the neutralization, with a strong alkali such as sodium hydroxide or the like, of a compound of sulfuric acid and titanium or a compound of phosphoric acid and titanium.

The solid lubricant/water-soluble inorganic salt weight ratio (B)/(A) in the waterborne lubricant according to the present invention must be in the range from 0.05:1 to 2:1 and is preferably in the range from 0.1:1 to 1.5:1 and more preferably is in the range from 0.3:1 to 1.5:1. The particular value of this ratio is preferably selected based on the specific shape of the metal stock to be subjected to plastic working, the working conditions, the working device, and so forth. When this weight ratio has a value below 0.05: 1, the resulting coating has reduced lubricating properties and scuffing and seizure of the metal workpiece will often occur. A weight ratio in excess of 2:1 results in a reduced adhesion between the substrate and the resulting coating and a reduced coating hardness. When the metal is introduced to the mouth of the tool under these circumstances, the dried coating formed on the surface is very prone to debonding, which results in impaired lubricating properties.

The weight ratio of oily component to the sum of the water-soluble inorganic salt and solid lubricant {(C)/(A)+(B)} must be in the range from 0.05:1 to 1.0:1 and preferably is in the range from 0.1:1 to 0.8:1. A weight ratio below 0.05:1 results in a diminished bleed by the oily component onto the surface of the coating during drying. This results in a substantial impairment of a major feature of the present waterborne lubricant, i.e., the supplementation or compensation, by the bled-out oily component, of the lubricity in regions that would otherwise suffer from a diminished seizure resistance due to a nonuniform uptake of the solid lubricant. While bleed out by the oily component onto the coating surface does not pose any problems at weight ratios in excess of 1.0:1, the corresponding coating is usually neither hard nor solid, and this reduces the persistence of the lubricant in place during the entire working time and thereby impairs the lubricating properties.

The amount of surfactant (D) used in the waterborne lubricant according to the present invention is not critical as long as at least the minimum amount is used that is capable of emulsifying the oily component in the water to homogeneity and dispersing the solid lubricant in the water to homogeneity. However, the use of too much surfactant facilitates foaming and is economically inefficient. The generally preferred concentration for the surfactant in the waterborne lubricant is 0.2 to 5 weight % of the total composition.

The solids fraction, defined as {A+B+C+D+optional solids (i.e., any solids in optional components such as the oiliness improver referenced above)}/(the total composition), in a waterborne lubricant according to the present invention is not critical. The preferred solids fraction is about 20 to 45 weight % during preparation, transport, and storage and about 5 to 45 weight % during application.

The method for preparing the waterborne lubricant according to the present invention is not critical and any method can be used that gives a waterborne lubricant meeting the conditions described above. In general, the waterborne lubricant is preferably prepared by dissolving the water-soluble inorganic salt (A) in water and then dispersing the solid lubricant (B) to homogeneity into this solution; adding to this a liquid in which the oily component (C) is homogeneously emulsified in water using the surfactant (D); and agitating the combination in order to homogeneously disperse the solid lubricant and homogeneously emulsify the oily component. Dispersion of the solid lubricant, emulsification of the oily component, and the final agitation are preferably effected by strong agitation using a homogenizer, in order to obtain a uniform and microfine emulsification and dispersion.

A waterborne lubricant according to the present invention can be diluted with water at the point of application as a function of the type of metal, type of cold plastic working, degree of metal working, and the like. Waterborne lubricants prepared by dilution are included within the scope of the present invention.

A process according to the invention for cold plastic working of a solid metal substrate by mechanically forcing said solid metal substrate through an opening bounded by at least one solid surface of at least one metal working tool comprises, at a minimum, steps of:

(I) coating, with a layer of a liquid waterborne lubricant according to the invention, any solid surface of said metal substrate that, if not coated, would contact a solid metal working tool surface during the process;

(II) drying the layer of liquid waterborne lubricant formed during step (I) into place over any solid surface of said metal substrate that was coated with a layer of liquid waterborne lubricant during step (I), so that the liquid layer is converted to a corresponding solid lubricant layer consisting of non-aqueous and non-volatile constituents of the liquid layer from which it was formed; and (III) mechanically forcing the solid metal substrate, while any of its surface that was covered with a liquid lubricant layer in step (I) remains coated with the corresponding solid lubricant layer formed in step (II), through said opening bounded by at least one metal working tool surface, so that the metal substrate is cold worked.

A waterborne lubricant according to the present invention can be used as lubricant in cold plastic working, e.g., tube and pipe drawing, wire drawing, forging, etc., of substrates such as tube stock, wire stock, bar stock, etc., of a metal such as iron, steel, titanium, titanium alloy, copper, copper alloy, aluminum, or aluminum alloy. It can be used in particular as lubricant for the drawing of steel tubing and pipe.

In order to obtain good results, prior to application of the waterborne lubricant according to the present invention, a work piece is preferably pretreated, in the order given, by degreasing (typically with an alkaline degreaser), washing with water, pickling (hydrochloric acid, for example, is used to remove oxide scale from the metal work piece and improve coating adherence), and washing with water. The pickling and ensuing water wash can be omitted when oxide scale is not present, as on most kinds of stainless steel, for example. This pretreatment can be carried out by the usual techniques.

A waterborne lubricant according to the present invention can be applied to the metal work piece by dipping, flow coating, and so forth. The temperature of the waterborne lubricant during application is not critical, but suitable temperatures fall in the range from ambient temperature to 90° C. The dipping time is also not critical, but dipping is suitably continued until the temperature of the metal work piece has reached the bath temperature, for example, generally about 5 to 10 minutes. After application and drainage, the dried coating is obtained by drying the applied coating in a drying oven, etc. The drying temperature is not critical, but will generally preferably be from 60° C. to 150° C.

The optimal thickness of the dried coating will vary as a function of the type of metal working, degree of working, and surface roughness. The coating will generally have an average mass, per unit area of work piece coated with the coating, that is from 1 to 50 grams per square meter, hereinafter usually abbreviated as "$g/m^2$", and preferably is from 5 to 40 $g/m^2$. When the dried coating is too thin, strong contact will occur between the tool and metal work piece and seizure will then be prone to occur. When the dried coating is too thick, a large amount of the dried coating will not be drawn into the working interface between workpiece and drawing tool, resulting in waste of the waterborne lubricant.

The waterborne lubricant according to the present invention can be applied to the plastic working of metals by the usual plastic working methods.

A solid coating according to the invention that remains on a work piece after plastic working can be easily stripped off.

Metal is typically formed or molded by plastic working in a repetitive sequence of lubrication treatment and then plastic working in order to gradually form the work piece into the desired product shape. During this process, the metal work piece is annealed in order to soften it, since the direct transfer of the work-hardened metal work piece to the next plastic working step would eventually interfere with forming due to the high working force required to further deform such work-hardened metal. When the lubricating coating remains present during annealing, the components in the lubricant can lead to infiltration of carbon, sulfur, phosphorus, etc., into the metal work piece, which can impair the corrosion resistance and mechanical strength of the metal itself. Moreover, the adherence of the new coating will be usually be poor when an old lubricating coating is present during the next lubrication treatment after a plastic working step.

As a result of these considerations, the residual coating is ordinarily removed after each cold working stage of a plastic working operation. However, the prior-art combined lubrication system of conversion coating treatment+reactive soap treatment at the very least requires alkaline degreasing and pickling (hydrochloric acid cleaning or sulfuric acid cleaning) to remove the residual coating. In contrast, with use of a waterborne lubricant according to the present invention, the residual coating can generally be removed with an alkaline degreaser alone. This alkaline degreaser can be an alkaline degreaser in general use, for example, an alkaline degreaser containing sodium phosphate, sodium silicate, surfactant, etc. A specific example of a useable alkaline degreaser is FINECLEANER™ 4360 from Nihon Parkerizing Company, Limited, Tokyo.

The function of the waterborne lubricant according to the present invention is not entirely clear. It is thought, however, that when the waterborne lubricant according to the present invention is coated on metal and then dried at elevated temperature to give the dried coating, the oily component, present as an emulsion, bleeds onto the outside of the coating, so that this bled-out oily component supplements the lubricity in those regions having a low dry coating add-on mass. In other words, due to the drying process-induced bleed onto the outer surfaces of the coating by the so-called lubrication auxiliary present as one component of the waterborne lubricant, seizure phenomena are substantially reduced due to a reduction in friction between the work piece and tool (e.g., die, plug, punch, etc.).

The reason why the residual coating can be so easily stripped off after the cold plastic working step is also not entirely clear. However, it is thought that the coating of water-soluble inorganic salt is itself easily removed by alkaline degreaser and that the solid lubricant and oily component taken up therein are also removed at the same time.

Waterbome lubricants according to the present invention will be illustrated in the following working examples, and their benefits may be further appreciated by contrast with the following comparison examples.

EXAMPLES 1 to 16

Pregaration and Application of Waterborne Lubricants and Testing in Steel Pipe Drawing Lubricants were prepared with the compositions reported in Tables 1 and 2. To prepare the lubricants, the water-soluble inorganic salt was dissolved in water and the solid lubricant was then uniformly dispersed in this solution. This was followed by the introduction of water in which the oily component was homogeneously emulsified by the surfactant. A homogenizer was used for preparing the separate dispersion and emulsification. The mixture of the dispersion and emulsion was stirred to give a uniform

TABLE 1

COMPOSITION DATA FOR EXAMPLES 1 TO 16

| Example Number | Variable Ingredients in Lubricant Composition (Percents as Weight % of Total Composition): Water Soluble Inorganic Salt Component (A) Name | % | Solid Lubricant Component (B) Name | % | Oily Component (C) Name | % |
|---|---|---|---|---|---|---|
| 1 | borax | 10.0 | calcium stearate | 10.0 | palm oil | 5.0 |
| 2 | borax | 20.0 | calcium stearate | 10.0 | ester oil | 10.0 |
| 3 | potassium tetraborate | 10.0 | calcium stearate | 5.0 | palm oil | 5.0 |
| 4 | potassium tetraborate | 15.0 | mica | 7.0 | palm oil | 10.0 |
| 5 | sodium sulfate | 12.0 | calcium stearate | 12.0 | machine oil | 6.0 |
| 6 | sodium sulfate | 15.0 | calcium stearate | 15.0 | ester oil | 5.0 |
| 7 | borax | 10.0 | calcium stearate | 10.0 | ester oil | 5.0 |
| 8 | borax | 20.0 | mica | 7.0 | ester oil | 15.0 |
| 9 | potassium tetraborate | 10.0 | calcium stearate | 2.0 | ester oil | 5.0 |
| 10 | potassium tetraborate | 10.0 | calcium stearate | 15.0 | ester oil | 5.0 |
| 11 | potassium tetraborate | 10.0 | calcium stearate | 5.0 | palm oil | 12.0 |
| 12 | potassium tetraborate | 15.0 | calcium stearate | 5.0 | palm oil | 15.0 |
| 13 | potassium tetraborate | 15.0 | PTFE | 1.0 | ester oil | 5.0 |
| 14 | potassium tetraborate | 15.0 | mica | 7.0 | ester oil | 15.0 |

TABLE 1-continued

COMPOSITION DATA FOR EXAMPLES 1 TO 16

| Example Number | Variable Ingredients in Lubricant Composition (Percents as Weight % of Total Composition): Water Soluble Inorganic Salt Component (A) Name | % | Solid Lubricant Component (B) Name | % | Oily Component (C) Name | % |
|---|---|---|---|---|---|---|
| 15 | sodium sulfate | 12.0 | calcium stearate | 12.0 | ester oil | 5.0 |
| 16 | sodium sulfate | 15.0 | calcium stearate | 10.0 | machine oil | 5.0 |

Note for Table 1
In addition to the ingredients shown in Table 1, every example had 1% by weight of poly{oxyethylene}alkyl ether surfactant, with the balance not otherwise accounted for being water.

dispersion of the solid lubricant and uniform emulsification of the oily component.

The starting materials used to prepare the waterborne lubricants had the following properties. The water-soluble inorganic salts were in all cases reagent first-grade quality. The calcium stearate used was a waterborne dispersion with 30% solids. The PTFE used was a waterborne dispersion with 60% solids. The machine oil had a viscosity of 46 millimeters squared per second, hereinafter usually abbreviated as "$mm^2/s$" at 40° C. The palm oil was a purified palm oil with a viscosity of 28 $mm^2/s$ at 50° C. The ester oil was the ester condensate of oleic acid dimer, lauric acid, and trimethylolpropane and had a viscosity of 64 $mm^2/s$ at 50° C. The surfactant was a polyoxyethylene alkyl ether and was added at 1 weight % of the total quantity of lubricant. The waterborne lubricant prepared as described above was applied to carbon steel pipe and stainless steel pipe (see below) and then dried, and the pipe carrying the resulting dried coating was subjected to a drawing test. The performance of the waterborne lubricant

TABLE 2

Composition Ratios and Test Evaluation Results for Examples 1–16

| Example Number | Composition Ratios (B)/(A) | Composition Ratios (C)/{(A) + (B)} | Dry Coating Add-On, $g/m^2$ | Substrate Type | Reduction Ratio in Drawing Test, % | Drawing Test Ratings: Pipe Surface Condition Outer | Pipe Surface Condition Inner | Coating Removability |
|---|---|---|---|---|---|---|---|---|
| 1 | 1.00 | 0.25 | 23.8 | STKM13A | 46.0 | +++ | +++ | +++ |
| 2 | 0.50 | 0.33 | 34.0 | STKM13A | 46.0 | +++ | +++ | +++ |
| 3 | 0.50 | 0.33 | 10.6 | STKM13A | 46.0 | +++ | +++ | +++ |
| 4 | 0.47 | 0.45 | 18.1 | STKM13A | 46.0 | ++ | ++ | +++ |
| 5 | 1.00 | 0.25 | 21.7 | STKM13A | 46.0 | ++ | ++ | +++ |
| 6 | 1.00 | 0.17 | 29.9 | STKM13A | 46.0 | +++ | ++ | +++ |
| 7 | 1.00 | 0.25 | 15.0 | SUS304 | 43.0 | +++ | +++ | +++ |
| 8 | 0.35 | 0.56 | 32.3 | SUS304 | 43.0 | ++ | ++ | +++ |
| 9 | 0.20 | 0.42 | 8.6 | SUS304 | 43.0 | ++ | ++ | +++ |
| 10 | 1.50 | 0.20 | 18.8 | SUS304 | 43.0 | +++ | +++ | +++ |
| 11 | 0.50 | 0.80 | 21.2 | SUS304 | 43.0 | +++ | +++ | +++ |
| 12 | 0.33 | 0.75 | 24.5 | SUS304 | 43.0 | +++ | +++ | +++ |
| 13 | 0.07 | 0.31 | 16.7 | SUS304 | 43.0 | ++ | ++ | ++ |
| 14 | 0.47 | 0.68 | 24.8 | SUS304 | 43.0 | ++ | ++ | +++ |
| 15 | 1.00 | 0.21 | 20.1 | SUS304 | 43.0 | +++ | ++ | +++ |
| 16 | 0.67 | 0.20 | 19.9 | SUS304 | 43.0 | ++ | ++ | +++ |

was evaluated based on the extent of scratching on the inside and outside of the pipes. The drawing stock was STKM13A carbon steel pipe with an outside diameter of 25.4 millimeters, hereinafter usually abbreviated as "mm", and a wall thickness of 3.0 mm or SUS304 stainless steel pipe with an outside diameter of 25.0 mm and a wall thickness of 2.5 mm.

Prior to application of the waterborne lubricant, the pipe was subjected to the pretreatment described below. The carbon steel pipe was subjected to process steps (1) to (4) in the order given, while the stainless steel pipe was subjected to process steps (1) and (2) in the order given.

(1) Degreasing alkaline degreaser: FINECLEANER™ 4360 from Nihon Parkerizing Company, Ltd.

concentration: 20 grams per liter, hereinafter usually abbreviated as "g/L"

temperature: 60° C.

dipping time: 10 minutes (2) Water wash: dipping in tap water at ambient temperature (3) Pickling industrial hydrochloric acid concentration: 17.5 weight % temperature: ambient dipping time: 10 minutes (4) Water wash: dipping in tap water at ambient temperature The waterborne lubricant was applied by immersion at a treatment bath temperature of 50° C. After treatment, the treated work piece was dried by placement in a tunnel-shaped drying box and heating for 1 hour at 100° C. to 120° C., using a kerosene-fired jet heater.

The drawing test was run using a 10-tonne chain-type drawbench and a die (Model KD Superhard Die from Fuji Die Company, Limited) and plug (Model MB Superhard Plug from Fuji Die Company, Limited) composed of superhard tooling. The draw rate was 17 meters per minute. The reduction ratio (=cross section reduction ratio) was set at 46% for the STKM13A stock (outside diameter after drawing=20 mm, wall thickness=2 mm) and 43% for the SUS304 stock (outside diameter after drawing=20 mm, wall thickness=1.75 mm). The reduction ratio was calculated from the equation:

$$\text{reduction ratio } (\%)=\{(A_0-A_1)/A_0\}\times 100,$$

where $A_0$ is the pre-working cross-sectional area of the pipe and $A_1$ is the post-working cross-sectional area of the pipe.

Scratch development on the inner and outer surfaces of the pipe was evaluated by visual inspection of the drawn pipe and was rated on the following 4-level scale:

+++:no scratching, no unevenness in the finish;

++:no scratching, but an uneven finish was observed;

+:minor scratching was observed;

x:scratching was clearly observed.

In this evaluation, scratching denotes striplike seizure scratching observed on the inner or outer surface of the pipe, while an uneven finish refers to differences in gloss caused by a mixture of glossy regions and orange peel-like textured regions on the surface after drawing.

The post-working removability of the residual coating was evaluated using an alkaline degreaser (FINECLEANER™ 4360 from Nihon Parkerizing Co., Ltd., concentration=20 g/L, temperature=60° C.). The alkaline-degreased pipe was visually inspected and rated on the following 4-level scale:

+++:no residual coating could be observed after immersion for 5 minutes;

++:no residual coating could be observed after immersion for 10 minutes;

+:coating remained even after immersion for 10 minutes;

x :coating remained even after immersion for 20 minutes.

The results of the drawing tests are reported in Table 2.

Comparison Examples 1 to 10

Waterborne lubricants were prepared as in Examples 1 to 16, but in these instances using the compositions reported in Tables 3 and 4. Testing was also carried out as in Examples 1 to 16. These results are reported in Table 4.

Problems occurred with all the lubricants outside the scope of the present invention, e.g., scratching on the inner or outer wall of the test-drawn pipe, poor removal by alkaline degreasing of the residual post-working coating, etc.

Comparison Examples 11 and 12

For Comparison Example 11, Type STKM13A Steel as used in Examples 1 to 16 was subjected to a zinc phosphate conversion treatment by immersion for 10 minutes in a solution in water containing 90 g/L of a commercially available product, PALBOND® 181× concentrate from Nihon Parkerizing Co., Ltd., Tokyo; the solution was maintained at 80° C. during the immersion. For Comparison Example 12, Type SUS304 stainless steel as used in Examples 1 to 16 was subjected to an oxalate conversion coating by immersion for 10 minutes at 95° C. in a solution in water containing 35 g/L of FERRBOND® A Agent #1 and 17 g/L of FERRBOND® A Agent #2.

After completion of these conversion coatings, both types of pipe were immersed for 5 minutes at 80° C. in a solution in water containing 70 g/L of PALUBE® 235 concentrate. (All materials identified by trademarks in this description of Comparison Examples 11 and 12 are commercially available from Nihon Parkerizing Co., Ltd., Tokyo.) The resulting lubricated steel pipe was subjected to the same drawing test as described for Examples 1 to 16. The results of these tests and some additional characteristics of the coatings are reported in Table 5. Neither seizure nor finish unevenness occurred in these comparison examples, but the post-draw removability of the residual coating was poor.

TABLE 3

COMPOSITION DATA FOR COMPARISON EXAMPLES 1–10

| Comparison Example Number | Variable Ingredients in Lubricant Composition (Percents as Weight % of Total Composition) | | | | | |
|---|---|---|---|---|---|---|
| | Water Soluble Inorganic Salt Component (A) | | Solid Lubricant Component (B) | | Oily Component (C) | |
| | Name | % | Name | % | Name | % |
| 1 | borax | 10.0 | calcium stearate | 10.0 | palm oil | 0.5 |
| 2 | borax | 20.0 | calcium stearate | 0.5 | ester oil | 10.0 |
| 3 | potassium tetraborate | 10.0 | calcium stearate | 5.0 | palm oil | 0.5 |
| 4 | sodium sulfate | 12.0 | calcium stearate | 12.0 | machine oil | 30.0 |
| 5 | borax | 10.0 | calcium stearate | 25.0 | machine oil | 5.0 |
| 6 | potassium tetraborate | 10.0 | calcium stearate | 2.0 | machine oil | 15.0 |
| 7 | potassium tetraborate | 10.0 | PTFE | 21.0 | palm oil | 5.0 |
| 8 | potassium tetraborate | 15.0 | calcium stearate | 0.5 | ester oil | 5.0 |

TABLE 3-continued

COMPOSITION DATA FOR COMPARISON EXAMPLES 1–10

| Comparison Example Number | Variable Ingredients in Lubricant Composition (Percents as Weight % of Total Composition) | | | | | |
|---|---|---|---|---|---|---|
| | Water Soluble Inorganic Salt Component (A) | | Solid Lubricant Component (B) | | Oily Component (C) | |
| | Name | % | Name | % | Name | % |
| 9 | potassium tetraborate | 10.0 | mica | 21.0 | ester oil | 5.0 |
| 10 | sodium sulfate | 12.0 | calcium stearate | 12.0 | ester oil | 1.0 |

Note for Table 3
In addition to the ingredients shown in Table 3, each of comparison examples 1 through 10 had 1% by weight of poly{oxyethylene}alkyl ether surfactant, with the balance not otherwise accounted for being water.

TABLE 4

COMPOSITION RATIO AND TEST EVALUATION RESULTS FOR COMPARISON EXAMPLES 1–10

| Comparison Example Number | Composition Ratios (B)/(A) | (C)/{(A) + (B)} | Dry Coating Add-On, g/m$^2$ | Substrate Type | Reduction Ratio in Drawing Test, % | Drawing Test Ratings: Pipe Surface Condition Outer | Inner | Coating Removability |
|---|---|---|---|---|---|---|---|---|
| 1 | 1.00 | 0.03 | 28.3 | STKM13A | 46.0 | + | ++ | +++ |
| 2 | 0.03 | 0.49 | 15.5 | STKM13A | 46.0 | × | × | +++ |
| 3 | 0.50 | 0.03 | 10.2 | STKM13A | 46.0 | + | ++ | +++ |
| 4 | 1.00 | 1.25 | 35.1 | STKM13A | 46.0 | + | + | +++ |
| 5 | 2.50 | 0.14 | 32.1 | SUS304 | 43.0 | + | + | +++ |
| 6 | 0.20 | 1.25 | 11.8 | SUS304 | 43.0 | ++ | + | +++ |
| 7 | 2.10 | 0.08 | 29.5 | SUS304 | 43.0 | +++ | +++ | × |
| 8 | 0.03 | 0.32 | 15.8 | SUS304 | 43.0 | × | × | +++ |
| 9 | 2.10 | 0.08 | 19.4 | SUS304 | 43.0 | ++ | ++ | + |
| 10 | 1.00 | 0.04 | 22.7 | SUS304 | 43.0 | ++ | + | +++ |

TABLE 5

COATING PARAMETERS AND EVALUATION TEST RESULTS, COMPARISON EXAMPLES 11–12

| Comparison Example No. | Coating Results: Coating Component | Add-On, g/L | Reduction Ratio in Drawing Test, % | Drawing Test Ratings: Pipe Surface Condition Outer | Inner | Coating Removability |
|---|---|---|---|---|---|---|
| 1 | Conversion coating mass | 8.2 | 46.0 | +++ | +++ | x |
| | Quantity of metal soap | 6.5 | | | | |
| | Quantity of hot water soluble soap | 3.7 | | | | |
| 2 | Conversion coating mass | 6.2 | 43.0 | +++ | +++ | x |
| | Quantity of metal soap | 3.0 | | | | |

TABLE 5-continued

COATING PARAMETERS AND EVALUATION TEST RESULTS, COMPARISON EXAMPLES 11–12

| Comparison Example No. | Coating Results: Coating Component | Add-On, g/L | Reduction Ratio in Drawing Test, % | Drawing Test Ratings: Pipe Surface Condition Outer | Inner | Coating Removability |
|---|---|---|---|---|---|---|
| | Quantity of hot water soluble soap | 1.5 | | | | |

EXAMPLES 17 to 19

Preparation and application of the waterborne lubricants and forging testing The waterborne lubricants were prepared as described for Examples 1 to 16, but using the compositions reported in Table 6. The resulting waterborne lubricants were coated on carbon steel followed by drying, and the dry-coating bearing carbon steel was then subjected to backward punching. The performance of the waterborne lubricants was evaluated based on the depth to which the samples could be satisfactorily punched in an apparatus partially illustrated in drawing FIG. 1.

TABLE 6

COMPOSITION DATA FOR EXAMPLES 17–19

| Comparison Example Number | Variable Ingredients in Lubricant Composition (Percents as Weight % of Total Composition) | | | | | |
|---|---|---|---|---|---|---|
| | Water Soluble Inorganic Salt Component (A) | | Solid Lubricant Component (B) | | Oily Component (C) | |
| | Name | % | Name | % | Name | % |
| 17 | potassium tetraborate | 10.0 | calcium stearate | 5.0 | palm oil | 5.0 |

TABLE 6-continued

COMPOSITION DATA FOR EXAMPLES 17–19

| Comparison Example Number | Variable Ingredients in Lubricant Composition (Percents as Weight % of Total Composition) | | | | | |
|---|---|---|---|---|---|---|
| | Water Soluble Inorganic Salt Component (A) | | Solid Lubricant Component (B) | | Oily Component (C) | |
| | Name | % | Name | % | Name | % |
| 18 | potassium tetraborate | 20.0 | calcium stearate | 5.0 | ester oil | 10.0 |
| 19 | borax | 15.0 | zinc stearate | 10.0 | palm oil | 10.0 |

Note for Table 6
In addition to the ingredients shown in Table 6, each of examples 17 through 19 had 1% by weight of poly{oxyethylene}alkyl ether surfactant, with the balance not otherwise accounted for being water.

Figure 2:
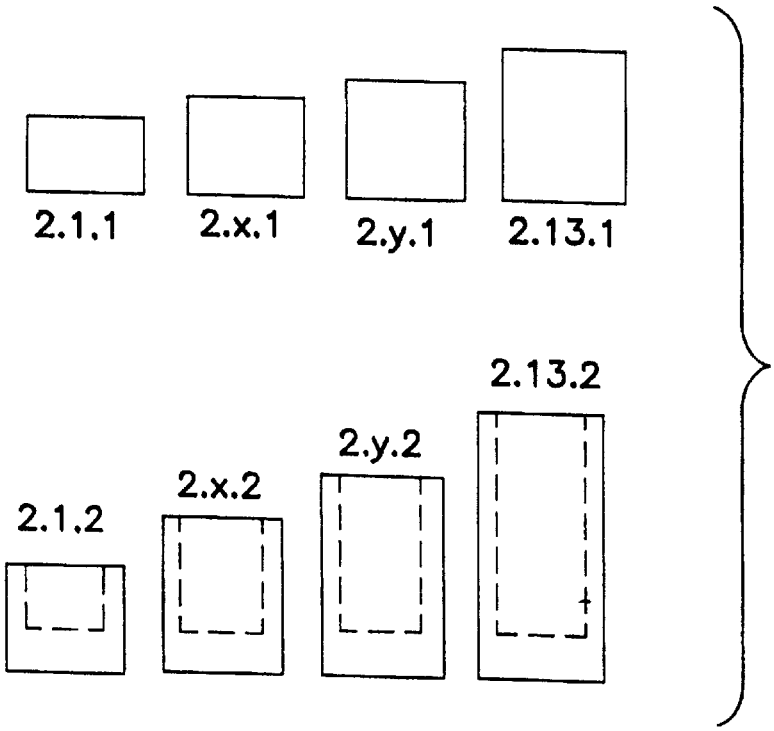
FIGS. 2.1.1, 2.x.1, 2.y.1, 2.13.1, 2.1.2, 2.x.2, 2.y.2, and 2.13.2 are projection views of various sized substrates for this test before and after punching has occurred.

The substrate stock for the backward punching test was a commercial S45C normalized carbon steel (hardness about Hv 180). All of the test specimens depicted in FIGS. 2.1.1, 2.x.1, etc. had a diameter of 30 mm, while the initial height of the test specimens varied from 16 mm to 40 mm at 2-mm intervals, resulting in 13 distinct initial height values, only four of which, including the smallest and the largest, are depicted in the drawing figure numbers beginning with "2". The final digit of these figure numbers is "1" for initial test specimens, while the final test specimens formed by punching these initial test specimens have a final digit of "2", with all preceding parts of the figure number the same as for the corresponding initial test specimen.

The waterborne lubricant was applied to the initial test specimens by dipping at a waterborne lubricant temperature of 80° C. The liquid coating in place on the substrate was then dried for one hour using a forced convection drying oven at 90° C. to 100° C.

The backward punching test was run using a 200-tonne crank press. The punch 1 in drawing FIG. 1 was driven from above onto the circular test specimen 2 set in the die 3 with its circumference held to give a cup-shaped molding. The SKD11 die had an inside diameter of 30.4 mm for the test specimen insertion zone. The SKH53 punch had an outside diameter of 21.21 mm on its lower end, which was driven into the specimen, after the latter was in place in the die, at an operating rate of 30 strokes/minute. The terminal point of the press was controlled so as to give a 10-mm residual margin at the bottom of the final test specimen in all the tests. As a result, the surface enlargement ratio of the worked part increased with test specimen height (deeper hole). The shortest substrate sample thus tested increased in length from 16 to 20 mm, corresponding to a 10 mm hole depth, as a result of this punching, while the longest substrate sample thus tested increased in length from 40 to 70 mm, corresponding to a hole depth of 60 mm. Test substrate cylinders such as those depicted in FIGS. 2.x.1 and 2.y.1 with intermediate initial heights had intermediate hole depths. The performance of the waterborne lubricant was evaluated based on the hole depth that could be worked without seizure ("good-punch depth"). The results are reported in Table 7.

Benefits of the Invention

The waterborne lubricant according to the present invention provides, in a single step, the same lubrication performance in the cold plastic working of metals as the prior-art two or more step conversion coating/reactive soap treatment. At the same time, treatment according to the invention provides substantial improvement in the working environment, treatment bath management, waste disposal, and so forth. Moreover, use

TABLE 7

COMPONENT RATIOS AND TEST RESULTS FOR EXAMPLES 17–19

| Example Number | Component Ratios | | Dry Coating Add-On Mass, $g/m^2$ | Good-Punch Depth, mm |
|---|---|---|---|---|
| | (B)/(A) | (C)/{(A) + (B)} | | |
| 17 | 0.50 | 0.33 | 14.8 | 44 |
| 18 | 0.25 | 0.40 | 22.6 | 48 |
| 19 | 0.67 | 0.40 | 30.4 | 52 |

of the waterborne lubricant according to the present invention in the cold plastic working of metals provides an easier post-working removal of the residual coating than in conversion coating plus reactive soap treatment.

What is claimed is:

1. A waterborne lubricant useful for the cold plastic working of metals, said waterborne lubricant comprising a homogeneous mixture of water and:

(A) a water-soluble inorganic salt;

(B) a solid lubricant;

(C) a homogeneously emulsified component of at least one substance selected from the group consisting of mineral oils, animal oils, plant oils, fats, and synthetic oils; and (D) a surfactant, in which the solid lubricant to water-soluble inorganic salt weight ratio {"(B)/(A)"} is within the range of 0.05:1 to 2:1 and the oily component to (water-soluble inorganic salt+solid lubricant) weight ratio {""C)/(A)+(B)""} is within the range of 0.05:1 to 1:1.

2. A waterborne lubricant according to claim 1, wherein the water-soluble inorganic salt component (A) is selected from the group consisting of borax, potassium tetraborate, sodium sulfate, and mixtures of all or of any two of these.

3. A waterborne lubricant according to claim 2, wherein the solid lubricant component (B) is selected from the group consisting of micas, metal soaps, and mixtures of any two or more of metal soaps and micas.

4. A waterborne lubricant according to claim 1, wherein the solid lubricant component (B) is selected from the group consisting of micas, metal soaps, and mixtures of any two or more of metal soaps and micas.

5. A process for cold plastic working of a solid metal substrate by mechanically forcing said solid metal substrate through an opening bounded by at least one solid surface of at least one metal working tool, said process comprising steps of:

(I) coating, with a layer of a liquid waterborne lubricant, any solid surface of said metal substrate that, if not coated, would contact a metal working tool surface during the process, wherein said waterborne lubricant comprises a homogeneous mixture of (a) a water-soluble inorganic salt; (b) a solid lubricant; (c) a homogeneously emulsified component of at least one substance selected from the group consisting of mineral oils, animal oils, plant oils, fats, and synthetic oils; and (d) a surfactant;

(II) drying the layer of liquid waterborne lubricant formed during step (I) into place over any solid surface of said metal substrate that was coated with a layer of liquid waterborne lubricant during step (I), so that the liquid layer is converted to a corresponding solid lubricant layer of all non-aqueous and non-volatile constituents of the liquid layer; and (III) mechanically forcing the solid metal substrate, while any of its surface that was covered with a liquid lubricant layer in step (I) remains coated with the corresponding solid lubricant layer formed in step (II), through said opening bounded by at least one metal working tool surface, so that the metal substrate is cold worked.

6. A process according to claim 5, wherein any solid lubricant layer formed in step (II) has an add-on mass per unit area that is from 1 to 50 grams per square meter.

7. A process for cold plastic working of a solid metal substrate by mechanically forcing said solid metal substrate through an opening bounded by at least one solid surface of at least one metal working tool, said process comprising steps of:

(I) coating, with a layer of a liquid waterborne lubricant, any solid surface of said metal substrate that, if not coated, would contact a metal working tool surface during the process, wherein said waterborne lubricant comprises a homogeneous mixture of (a) a water-soluble inorganic salt; (b) a solid lubricant; (c) a homogeneously emulsified component of at least one substance selected from the group consisting of mineral oils, animal oils, plant oils, fats, and synthetic oils; and (d) a surfactant and exhibits a weight ratio of solid lubricant to water-soluble inorganic salt that is within the range of 0.05=14 2;

(II) drying the layer of liquid waterborne lubricant formed during step (I) into place over any solid surface of said metal substrate that was coated with a layer of liquid waterborne lubricant during step (I), so that the liquid layer is converted to a corresponding solid lubricant layer of all non-aqueous and non-volatile constituents of the liquid layer; and (III) mechanically forcing the solid metal substrate, while any of its surface that was covered with a liquid lubricant layer in step (I) remains coated with the corresponding solid lubricant layer formed in step (II), through said opening bounded by at least one metal working tool surface, so that the metal substrate is cold worked.

8. A process according to claim 7, wherein the solid lubricant layer formed in step (II) has an add-on mass per unit area that is from 1 to 50 grams per square meter.

9. A process for cold working a solid metal substrate including the step of:

cold working a solid metal substrate having a solid lubricating layer made by drying thereon an aqueous composition containing a homogeneous mixture of (a) a water-soluble inorganic salt; (b) a solid lubricant; (c) an emulsified component of at least one substance selected from the group consisting of mineral oils, animal oils, plant oils, fats, and synthetic oils; and (d) a surfactant.

10. A process according to claim 9 wherein said water-soluble inorganic salt is a borate, a sulfate, a silicate, a nitrate, or a combination of two or more of these salts.

11. A process according to claim 9 wherein said water-soluble inorganic salt is sodium tetraborate, potassium tetraborate, ammonium tetraborate, sodium sulfate, potassium sulfate, ammonium sulfate, sodium silicate, potassium silicate, sodium nitrate, or potassium nitrate.

12. A process according to claim 11 wherein said water-soluble inorganic salt is sodium tetraborate, potassium tetraborate, or sodium sulfate.

13. A process according to claim 9 wherein said solid lubricant is in a powder form.

14. A process according to claim 9 wherein said solid lubricant is mica; a calcium compound; a metal sulfide; a nitride; a lubricious metal oxide; a solid polymer; graphite; talc; a lubricious metal; a metal salt of a fatty acid, or a mixture of any of these.

15. A process according to claim 14 wherein said solid lubricant is mica, calcium stearate, or a metal soap.

16. A process for forming a solid lubricating layer on a metal substrate that can later be cold worked into a desired shape, said process comprising:

coating a metal substrate with a liquid waterborne lubricant comprising a homogeneous mixture of (a) a water-soluble inorganic salt; (b) a solid lubricant; (c) an emulsified component of at least one substance selected from the group consisting of mineral oils, animal oils, plant oils, fats, and synthetic oils; and (d) a surfactant, and drying the coated metal substrate to form a solid lubricant layer on said metal substrate.

* * * * *

UNITED STATES PATENT AND TRADEMARK OFFICE

CERTIFICATE OF CORRECTION

PATENT NO. : 6,194,357 B1
DATED : February 27, 2001
INVENTOR(S) : Murata et al.

It is certified that error appears in the above-identified patent and that said Letters Patent is hereby corrected as shown below:

Column 17,
Line 32, delete “0.05=14 2;”, and insert therefor -- 0.05 - 2; --.

Signed and Sealed this

Tenth Day of February, 2004

JON W. DUDAS
*Acting Director of the United States Patent and Trademark Office*